US011435110B2

(12) United States Patent
Zemborain et al.

(10) Patent No.: US 11,435,110 B2
(45) Date of Patent: Sep. 6, 2022

(54) AIR CONDITIONER WITH WINDOW CONNECTION

(71) Applicant: Electrolux Appliances Aktiebolag, Stockholm (SE)

(72) Inventors: Pedro Zemborain, Stockholm (SE); Emme Copparstad, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 16/300,662

(22) PCT Filed: May 27, 2016

(86) PCT No.: PCT/EP2016/062022
§ 371 (c)(1),
(2) Date: Nov. 12, 2018

(87) PCT Pub. No.: WO2017/202472
PCT Pub. Date: Nov. 30, 2017

(65) Prior Publication Data
US 2019/0212028 A1 Jul. 11, 2019

(51) Int. Cl.
*F24F 13/02* (2006.01)
*E06B 7/03* (2006.01)
(Continued)

(52) U.S. Cl.
CPC ..... *F24F 13/0254* (2013.01); *E06B 7/03* (2013.01); *F24F 1/022* (2013.01); *F24F 1/04* (2013.01); *F24F 1/58* (2013.01); *F24F 13/18* (2013.01)

(58) Field of Classification Search
CPC ..... F24F 13/0254; F24F 1/022; F24F 1/04; F24F 1/58; F24F 13/18; F24F 1/031; E06B 7/03
(Continued)

(56) References Cited

U.S. PATENT DOCUMENTS 399,491 A 3/1889 Bukawietis
1,954,017 A 4/1934 Manning
(Continued)

FOREIGN PATENT DOCUMENTS

CN 2190590 Y 3/1995
CN 2413205 Y 1/2001
(Continued)

OTHER PUBLICATIONS

International Search Report and Written Opinion for International Application No. PCT/EP2016/062022, dated Jan. 23, 2017—9 pages.
(Continued)

*Primary Examiner* — Steven B McAllister
*Assistant Examiner* — Charles R Brawner
(74) *Attorney, Agent, or Firm* — RatnerPrestia

(57) ABSTRACT

A connector to fit in a window gap, the connector having a generally elongated shape and having two parts being slidable in relation to each other. The connector includes an air-inlet adapted to receive air from an air conditioner and an air outlet. The two parts include a body and a telescopic part and the connector is adapted to be manipulated to be in: a first state where the body and the telescopic part can be moved in relation to each other in a length direction of the connector, or a second state where the body and the telescopic part are locked in relation to each other in a length direction of the connector by a locking mechanism.

9 Claims, 3 Drawing Sheets

(51) Int. Cl.

| | |
|---|---|
| ***F24F 13/18*** | (2006.01) |
| ***F24F 1/04*** | (2011.01) |
| ***F24F 1/58*** | (2011.01) |
| ***F24F 1/022*** | (2019.01) |

(58) Field of Classification Search
USPC ..... 454/126, 200–201, 203, 208, 210, 214, 454/216
See application file for complete search history.

(56) References Cited

U.S. PATENT DOCUMENTS

| | | | | |
|---|---|---|---|---|
| 2,234,753 | A | 3/1941 | Frazer | |
| 2,268,451 | A | 12/1941 | Hull | |
| 2,320,436 | A | 6/1943 | Hull | |
| 2,436,713 | A | 2/1948 | Cody | |
| 2,568,968 | A | 9/1951 | Perrin | |
| 2,608,148 | A | 8/1952 | Shapiro | |
| 2,708,833 | A | 5/1955 | Nigro | |
| 2,814,244 | A | 11/1957 | Hord | |
| 2,818,793 | A | 1/1958 | Hord | |
| 2,925,026 | A | 2/1960 | Schuster et al. | |
| 2,935,284 | A | 5/1960 | Reeves | |
| 3,030,873 | A | 4/1962 | Metcalfe | |
| 3,134,319 | A | 5/1964 | Marsteller | |
| 3,476,033 | A | 11/1969 | Appel | |
| 3,481,264 | A | 12/1969 | Ulich | |
| 3,491,549 | A | 1/1970 | Oglesby | |
| 3,552,470 | A | 1/1971 | Metcalfe | |
| 3,554,476 | A | 1/1971 | Gaylor, Jr. | |
| 3,698,308 | A * | 10/1972 | Navara | E06B 7/03 454/213 |
| 3,911,803 | A | 10/1975 | Kong et al. | |
| 3,911,903 | A | 10/1975 | Kong et al. | |
| 4,086,886 | A | 5/1978 | Edmaier et al. | |
| 4,152,844 | A | 5/1979 | Materniak et al. | |
| 4,203,302 | A | 5/1980 | Lapeyre | |
| 4,334,461 | A | 6/1982 | Ferguson et al. | |
| 5,027,614 | A | 7/1991 | Mori et al. | |
| 5,167,131 | A | 12/1992 | Karkhanis | |
| 5,290,343 | A | 3/1994 | Morita et al. | |
| 5,365,992 | A | 11/1994 | Swain et al. | |
| 5,582,025 | A | 12/1996 | Dubin et al. | |
| 5,823,289 | A | 10/1998 | Csomos | |
| 5,979,172 | A | 11/1999 | Teller | |
| 5,979,533 | A | 11/1999 | Dupuie | |
| 6,173,930 | B1 | 1/2001 | Arbucci | |
| 6,257,013 | B1 | 7/2001 | Murray et al. | |
| 6,416,570 | B2 | 7/2002 | Goto et al. | |
| 6,568,201 | B1 | 5/2003 | Cur et al. | |
| 6,767,278 | B1 | 7/2004 | Peterson | |
| 6,983,621 | B2 | 1/2006 | Cur et al. | |
| 7,121,105 | B1 | 10/2006 | Rais | |
| 7,296,424 | B2 | 11/2007 | Thompson | |
| 7,332,019 | B2 | 2/2008 | Bias et al. | |
| 7,350,759 | B1 | 4/2008 | Gray | |
| 7,601,204 | B2 | 10/2009 | Woodruff et al. | |
| 7,854,141 | B1 | 10/2010 | Breen | |
| 7,896,957 | B2 | 3/2011 | Zhao et al. | |
| 7,975,441 | B2 | 7/2011 | McCarriston | |
| 8,091,844 | B1 | 1/2012 | Bragg | |
| 8,104,240 | B2 | 1/2012 | McCarriston | |
| 8,578,728 | B2 * | 11/2013 | Cho | E06B 7/03 62/262 |
| 8,584,998 | B1 | 11/2013 | Peterson | |
| 9,163,854 | B2 | 10/2015 | Arbuccci | |
| 9,179,794 | B2 | 11/2015 | Darby | |
| 9,303,895 | B1 | 4/2016 | Grant | |
| 9,447,916 | B2 | 9/2016 | Darby et al. | |
| D782,289 | S | 3/2017 | Darby et al. | |
| 9,605,870 | B2 | 3/2017 | Darby et al. | |
| 9,909,712 | B1 | 3/2018 | Darby | |
| 9,938,044 | B2 | 4/2018 | Gamboa | |
| 9,982,909 | B1 | 5/2018 | Perez et al. | |
| 10,077,918 | B2 | 9/2018 | Darby et al. | |
| 10,104,964 | B2 | 10/2018 | Darby | |
| 10,104,965 | B1 | 10/2018 | Miller | |
| 10,203,130 | B2 | 2/2019 | Gardikis et al. | |
| 10,203,180 | B2 | 2/2019 | Miller et al. | |
| 10,295,221 | B2 | 5/2019 | Zhang | |
| 10,359,212 | B2 | 7/2019 | Darby | |
| 10,401,043 | B2 | 9/2019 | Li | |
| 10,408,494 | B2 | 9/2019 | Darby | |
| 10,520,206 | B2 | 12/2019 | Xu et al. | |
| 10,775,054 | B2 | 9/2020 | Bradford et al. | |
| 10,900,689 | B2 | 1/2021 | Weiner | |
| 2001/0032545 | A1 | 10/2001 | Goto et al. | |
| 2003/0097854 | A1 | 5/2003 | Cur et al. | |
| 2003/0110789 | A1 | 6/2003 | Cur et al. | |
| 2005/0028545 | A1 | 2/2005 | Herbert | |
| 2006/0021359 | A1 | 2/2006 | Hur et al. | |
| 2007/0023592 | A1 | 2/2007 | Makaso | |
| 2007/0068185 | A1 | 3/2007 | Thompson | |
| 2007/0137237 | A1 | 6/2007 | Rais | |
| 2008/0053309 | A1 | 3/2008 | Woodruff et al. | |
| 2008/0104989 | A1 | 5/2008 | Movshovitz | |
| 2010/0077924 | A1 | 4/2010 | Zhao et al. | |
| 2010/0097214 | A1 | 4/2010 | Sweeney et al. | |
| 2010/0229585 | A1 | 9/2010 | Bradford et al. | |
| 2010/0326103 | A1 | 12/2010 | Stamm et al. | |
| 2012/0137499 | A1 | 6/2012 | Agnihotri | |
| 2012/0274188 | A1 | 11/2012 | Shiborino | |
| 2013/0104581 | A1 | 5/2013 | Consoli | |
| 2013/0153744 | A1 | 6/2013 | Jin et al. | |
| 2013/0327509 | A1 | 12/2013 | Michitsuji | |
| 2014/0020421 | A1 | 1/2014 | Gallo | |
| 2014/0076506 | A1 | 3/2014 | Olivas | |
| 2014/0090334 | A1 | 4/2014 | Darby et al. | |
| 2014/0311063 | A1 * | 10/2014 | McIntyre | E06B 9/0692 52/203 |
| 2015/0034784 | A1 | 2/2015 | Darby | |
| 2015/0097096 | A1 | 4/2015 | Arbucci | |
| 2015/0211802 | A1 | 7/2015 | Yokozeki et al. | |
| 2015/0354838 | A1 | 12/2015 | Cur et al. | |
| 2016/0033166 | A1 | 2/2016 | Herbert | |
| 2016/0058189 | A1 | 3/2016 | Darby | |
| 2016/0097547 | A1 | 4/2016 | Selg et al. | |
| 2016/0298872 | A1 | 10/2016 | Darby et al. | |
| 2017/0153041 | A1 | 6/2017 | Darby et al. | |
| 2017/0159948 | A1 | 6/2017 | Darby | |
| 2017/0191763 | A1 | 7/2017 | Xu et al. | |
| 2017/0284683 | A1 | 10/2017 | Gallo et al. | |
| 2017/0297768 | A1 | 10/2017 | Gamboa | |
| 2017/0328596 | A1 | 11/2017 | Darby | |
| 2018/0023842 | A1 | 1/2018 | Gardikis, Sr. et al. | |
| 2018/0180305 | A1 | 6/2018 | Zhang | |
| 2019/0056143 | A1 | 2/2019 | Zhang | |
| 2019/0063760 | A1 | 2/2019 | Li | |
| 2019/0212032 | A1 | 7/2019 | Galvan | |
| 2020/0124296 | A1 | 4/2020 | Baumann et al. | |
| 2020/0248911 | A1 | 8/2020 | Lei et al. | |
| 2020/0333021 | A1 | 10/2020 | Galvan | |
| 2020/0363075 | A1 | 11/2020 | Bradford et al. | |
| 2021/0010688 | A1 | 1/2021 | Biasotti et al. | |
| 2021/0078118 | A1 | 3/2021 | Li et al. | |
| 2021/0088251 | A1 | 3/2021 | Martinez Galvan et al. | |
| 2021/0180828 | A1 | 6/2021 | Xing et al. | |
| 2021/0356146 | A1 | 11/2021 | Zhang et al. | |
| 2021/0404749 | A1 | 12/2021 | Wexler et al. | |

FOREIGN PATENT DOCUMENTS

| | | | |
|---|---|---|---|
| CN | 1338593 | A | 3/2002 |
| CN | 1445491 | A | 10/2003 |
| CN | 1595005 | A | 3/2005 |
| CN | 1727764 | A | 2/2006 |
| CN | 201104001 | Y | 8/2008 |
| CN | 201249077 | Y | 6/2009 |
| CN | 101523120 | A | 9/2009 |
| CN | 201589348 | U | 9/2010 |
| CN | 103471223 | A | 12/2013 |
| CN | 203379993 | U | 1/2014 |
| CN | 203501389 | U | 3/2014 |
| CN | 203518172 | U | 4/2014 |

(56) References Cited

FOREIGN PATENT DOCUMENTS

| | | | |
|---|---|---|---|
| CN | 104061632 | A | 9/2014 |
| CN | 203980467 | U | 12/2014 |
| CN | 204141751 | U | 2/2015 |
| CN | 204153874 | U | 2/2015 |
| CN | 204202053 | U | 3/2015 |
| CN | 204491248 | U | 7/2015 |
| CN | 205037425 | U | 2/2016 |
| CN | 205137735 | U | 4/2016 |
| CN | 106152315 | A | 11/2016 |
| CN | 106949559 | A | 7/2017 |
| CN | 206369283 | U | 8/2017 |
| CN | 107980091 | A | 5/2018 |
| CN | 109073269 | A | 12/2018 |
| DE | 4230604 | A1 | 3/1994 |
| EP | 0756140 | A2 | 1/1997 |
| EP | 1248049 | A2 | 10/2002 |
| EP | 1956307 | A1 | 8/2008 |
| EP | 2063192 | A1 | 5/2009 |
| FR | 755472 | A | 11/1933 |
| GB | 212669 | | 3/1924 |
| GB | 1239997 | | 7/1971 |
| GB | 2126695 | A | 3/1984 |
| JP | 54105838 | A | 8/1979 |
| JP | 07248128 | A | 9/1995 |
| JP | 08226745 | A | 9/1996 |
| JP | 2001239121 | A | 9/2001 |
| JP | 2002357338 | A | 12/2002 |
| JP | 2009144984 | A | 7/2009 |
| JP | 2012132640 | A | 7/2012 |
| KR | 20070077917 | A | 7/2007 |
| KR | 20160086637 | A | 7/2016 |
| KR | 20160111687 | A | 9/2016 |
| KR | 102187381 | B1 | 12/2020 |
| KR | 20210077328 | A | 6/2021 |
| WO | 8800676 | A1 | 1/1988 |
| WO | 0190657 | A1 | 11/2001 |
| WO | 2005054751 | A2 | 6/2005 |
| WO | 2005116530 | A1 | 12/2005 |
| WO | 2009052372 | A2 | 4/2009 |
| WO | 2011079371 | A1 | 7/2011 |
| WO | 2012056164 | A1 | 5/2012 |
| WO | 2014188526 | A1 | 11/2014 |
| WO | 2014206846 | A1 | 12/2014 |
| WO | 2015098157 | A1 | 7/2015 |
| WO | 2015115929 | A1 | 8/2015 |
| WO | 2017001914 | A1 | 1/2017 |
| WO | 2017045909 | A1 | 3/2017 |
| WO | 2017045934 | A1 | 3/2017 |
| WO | 2017075658 | A1 | 5/2017 |
| WO | 2017194092 | A1 | 11/2017 |
| WO | 2018090114 | A1 | 5/2018 |
| WO | 2020038239 | A1 | 2/2020 |

OTHER PUBLICATIONS

Chinese Office Action for Chinese Application No. 2016800860880, dated May 7, 2020, 8 pages.
Chinese Office Action issued in Chinese Application No. 2016800860880, dated Jan. 26, 2021, with translation, 18 pages.
Chinese Office Action for Chinese Application No. 201680028498.X, dated Sep. 4, 2019, with translation, 15 pages.
Chinese Office Action for Chinese Application No. 201680085261.5, dated Apr. 14, 2020, 11 pages.
Chinese Office Action for Chinese Application No. 201680085261.5, dated Dec. 11, 2020, with translation, 28 pages.
European Communication pursuant to Article 94(3) for European Application No. 16 721 184.6, dated Oct. 7, 2020, 7 pages.
International Search Report and Written Opinion for International Application No. PCT/IB2016/000949, dated Nov. 2, 2016, 9 pages.
International Search Report and Written Opinion for International Application No. PCT/EP2016/060396, dated Jan. 24, 2017, 9 pages.
International Search Report and Written Opinion for International Application No. PCT/EP2016/070382, dated Dec. 1, 2016, 14 pages.
International Search Report and Written Opinion for International Application No. PCT/EP2016/070702, dated Dec. 9, 2016, 9 pages.
Non Final Office Action for U.S. Appl. No. 16/771,107, dated Feb. 8, 2022, 11 pages.
Non Final Office Action for U.S. Appl. No. 16/771,111, dated Dec. 21, 2021, 41 pages.
Non Final Office Action for U.S. Appl. No. 16/771,456, dated Nov. 10, 2021, 39 pages.
Chinese Office Action for Chinese Application No. 201780097448.1, dated Jun. 29, 2021, with translation, 14 pages.
Chinese Office Action for Chinese Application No. 201780097456.6, dated Jan. 6, 2021, with translation, 19 pages.
Chinese Office Action with Search Report for Application No. 201780097448.1, dated Jan. 12, 2021, 8 pages. 2021.
Chinese Office Action with Search Report for Chinese Application No. 201780097449.6, dated Jan. 12, 2021, 8 pages.
International Preliminary Report on Patentability for International Application No. PCT/EP2017/082610, dated Jun. 16, 2020, 5 pages.
International Search Report and Written Opinion for International Application PCT/EP2017/082610, dated Aug. 21, 2018, 7 pages.
International Preliminary Report on Patentability for International Application No. PCT/EP2017/082615, dated Jun. 16, 2020, 7 pages.
International Preliminary Report on Patentability for International Application No. PCT/EP2017/082611, dated Jun. 16, 2020, 7 pages.
International Search Report and Written Opinion for International Application PCT/EP2017/082615, dated Aug. 9, 10 pages.
International Search Report and Written Opinion for International Application PCT/EP2017/082611, dated Aug. 9, 2018, 10 pages.
USPTO Final Office Action for U.S. Appl. No. 16/771,111, dated Apr. 19, 2022, 30 pages.
USPTO Notice of Allowance Issued in U.S. Appl. No. 16/771,107, dated Jul. 20, 2022, 9 pages.

* cited by examiner

AIR CONDITIONER WITH WINDOW CONNECTION

This application is a U.S. National Phase application of PCT International Application No. PCT/EP2016/062022, filed May 27, 2016, which is incorporated by reference herein.

TECHNICAL FIELD

The present disclosure relates to an air-conditioner. In particular the present disclosure relates to a portable air-conditioner.

BACKGROUND

Air conditioning (AC) is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology.

Existing portable air-conditioners are often found to be large, hard to handle, noisy and inefficient. Furthermore, the connected exhaust air outlet that removes the heat from the room is often complicated and inefficient in its design. A known portable air-conditioner is for example described in the U.S. Pat. No. 2,234,753.

A portable air conditioner requires an exhaust air outlet. The exhaust air outlet functions as the exit for the heat that is removed from the indoor space. In order for the indoor air to stay cool, the heat needs to be removed from the indoor space. This can be enabled by using an outlet device, typically a hose that can be connected to the AC unit. The hose is most often connected to a window where the hot air is exhausted. A window mounting device including a slidable adapter connection to fit in different window sizes is shown in WO 2014/206846.

There is a constant desire to improve the operation of air-conditioners. There is also a need to improve the outlet of air-conditioners. In particular portable air-conditioners Hence, there is a need for an improved air-conditioner.

SUMMARY

It is an object of the present invention to provide an improved air-conditioner that at least partly solves problems with existing air-conditioners.

This object and others are obtained by the air conditioner as set out in the appended claims.

In accordance with one embodiment a connector to fit in a window gap is provided. The connector has a generally elongated shape and comprises two parts being slidable in relation to each other. The connector comprises an air-inlet adapted to receive air from an air conditioner and an air outlet. The two parts comprises a body and a telescopic part and the connector is adapted to be manipulate to be in:

- a first state where the body and the telescopic part can be moved in relation to other in a length direction of the connector, or
- a second state where the body and the telescopic part are locked in relation to each other in a length direction of the connector by a locking mechanism.

Hereby the connector can easily be placed and locked in a window and similarly easily be removed from a window.

In accordance with one embodiment the locking mechanism comprises a lever adapted move the connector between the first state and the second state. Hereby a user-friendly maneuvering of the locking mechanism can be obtained.

In accordance with one embodiment the connector is adapted to expand in a length direction when moved from the first to the second state. Hereby the positioning of the connector in a window is even further facilitated.

In accordance with one embodiment at least one elastic member is provided in the connector. Hereby the connector becomes elastic and can be more easily fit into and held in place in a window.

In accordance with one embodiment one elastic member is provided at each end section of the connector and adapted to, when in use, press against a window frame. Hereby the elastic members will be pressing against the window and thereby reduce the wear on the window.

In accordance with one embodiment the at least one elastic member is more elastic than the body, and the telescopic part. Hereby it is ascertained that the elastic members are elastic enough.

In accordance with one embodiment the 1 eking mechanism comprises a lock adapted to engage projections of an insert. Hereby an easy to manipulate locking mechanism is obtained.

In accordance with one embodiment the insert comprises teeth forming the projections. Hereby, the projections can be formed at close distance enabling many locking positions in the connector to thereby make it easy to fit in many different window sizes.

The connector can advantageously be used with a portable air-conditioner.

BRIEF DESCRIPTION OF THE DRAWINGS

The present invention will now be described in more detail by way of non-limiting examples and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like or similar elements throughout the description.

Figure 1:
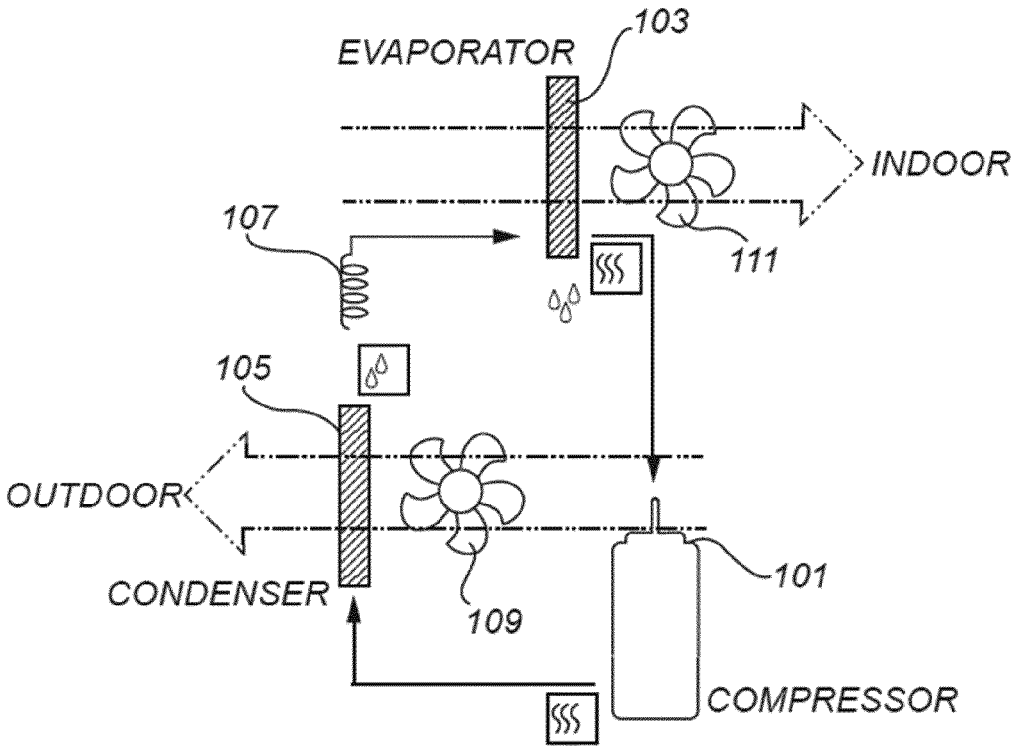
FIG. 1 illustrates the general principles of an air conditioner system.

FIG. 1 illustrates the general principles of an air conditioner system 100. The main parts of the system are the compressor 101, evaporator 103, condenser 105, and expansion device 107 such as a capillary tube. Also a condenser fan 109 and an evaporator fan 111 can be provided. The compressor 101 is connected in a circuit with the condenser 105, the evaporator 103, and the expansion device 107. A refrigerant is circulated in the circuit. The refrigerant has the ability to turn from liquid into vapor, and by that change in temperature. The tempered refrigerant and the indoor air work in symbiosis to exchange heat to each other.

Figure 2:
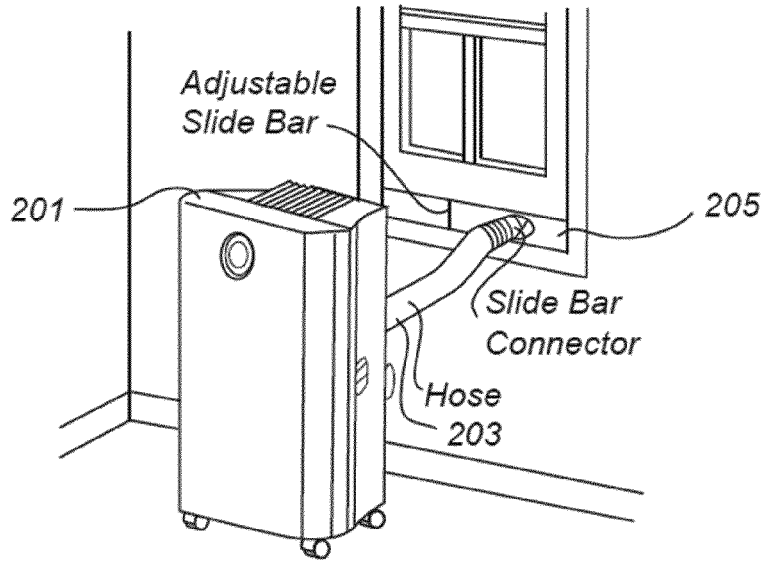
FIG. 2 illustrates a portable air-conditioner unit with a window connector.

In FIG. 2 a portable air-conditioner 201 is shown. A portable air conditioner requires an exhaust air outlet. The exhaust air outlet functions as the exit for the heat that is removed from the indoor space. In order for the indoor air to stay cool, the heat needs to be removed from the indoor space. This is enabled by using an outlet device, typically a hose 203 or a similar device that can be connected to the air-conditioner 201. The hose is most often connected to a window where the hot air is exhausted using a window connector 205 or similar. A window mounting kit can also be included when a portable air conditioner is purchased. The window mounting kit can comprise the connector 205 for mounting in the window. The connector can be slidable to fit in different window sizes.

Figure 3A:
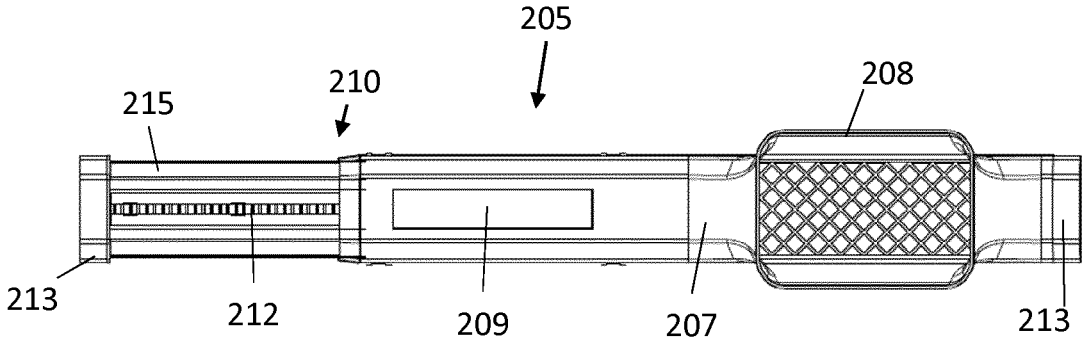
FIGS. 3*a*-3*c* are views of a window connector for an air conditioner.
Figure 3B:
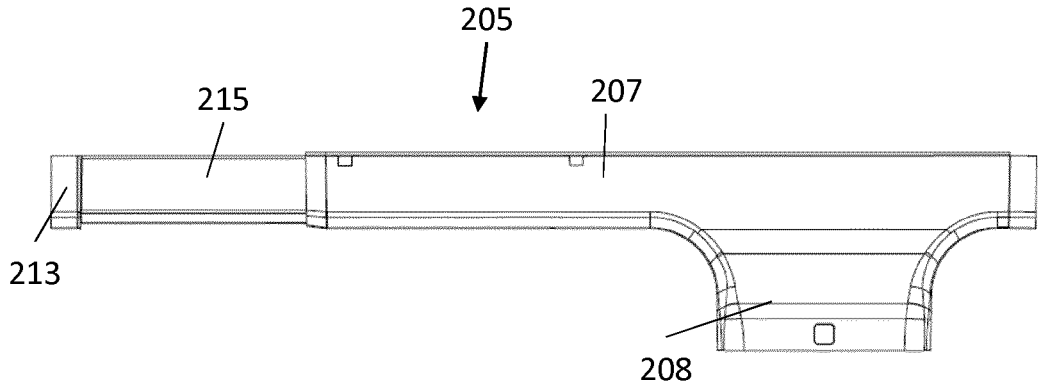
Figure 3C:
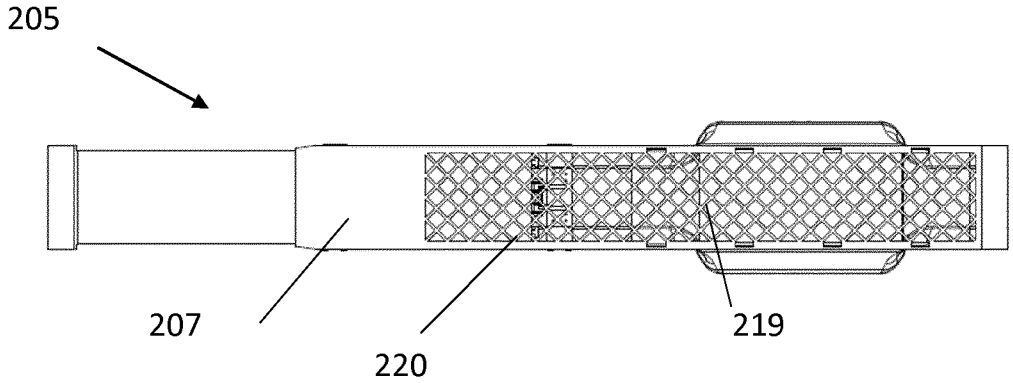

In order to securely mount the connector 205 in a window a connector 205 comprising a lock can be provided. The connector can be generally elongated in shape. In FIGS. 3*a*-3*c*, a window connector 205 having a lock 210 for a portable air-conditioner is shown. In FIG. 3*a* a front side view of the connector 205 from the side facing the room when in use is shown. The window connector 205 comprises a main part formed by a body 207. The connector 205 further comprises a telescopic part 215 slidably movable in relation to the body 207. The slidable movement is in the length direction of the connector 205. In this exemplary embodiment, the telescopic part 215 is insertable into the body 207. However, it is envisaged that other types of arrangements can be provided such as an arrangement where the telescopic part 215 is located on the outside of the body 207. The connector 205 further comprises an air inlet 208. The air inlet 208 can advantageously be provided in the body 207. The air inlet 208 is adapted to receive an air hose or an air pipe or a similar device connecting a warm air exhaust of an air-conditioner to the connector 205. In accordance with one embodiment the air-inlet 208 is adapted to be directly attached to an air-conditioner. The connector can further be provided with a locking mechanism 210. The locking mechanism 210 is adapted to lock the connector is a locked position. In particular the locked position can be a position where the telescopic part 215 is extended from the body 207. In accordance with one embodiment the locking can be combined with an extending movement in the length direction of the connector. In the exemplary embodiment of FIG. 3*a* the means for providing the combined locking and extension of the connector 205 is provided by a locking mechanism comprising a lever 209 interacting with an insert 212 via a lock 211 (see FIG. 4). The insert can be connected to the telescopic part 215 and the lever 209 can be provided on the body 207. Other configurations are also possible. For example the insert can be provided on the body 207 and the lever can be provided on the telescopic part 215. The insert 212 can interact with the lock 211 using a member on the lock locking into teeth or a similar projection of the insert. Similarly the lock 211 can have a teeth section and the insert 212 can be provided with a member for interacting with the teeth section of the lock.

When the connector 205 is inserted into a window gap the lever can be manipulated to cause the elongated connector 205 to expand in a length direction and lock in an extended position. To improve the stability of the connector in such a locked position, the connector can be provided with at least one elastic member 213. The elastic member 213 can for example be provided at an end section of the elongated connector 205. The elastic member 213 can however also be provided at some other location of the connector 205. The elastic member 213 makes the connector somewhat elastic in the length direction of the connector. Hereby, the connector, when placed in the locked position in a window gap will be held in place be a friction force provided by the elastic member(s) 213. The elastic member 213 can advantageously be more elastic than the body 207 or the telescopic part 215 or both the body 207 and the telescopic part 215. In accordance with one embodiment the connector 205 comprises an elastic member 213 at each end of the elongated connector 205 such that, when in use in a locked position of the connector, the elastic members 213 presses against the window frame in the window in which the connector 205 is mounted.

In FIG. 3*b* a top view of the connector 205 is shown. As is seen in FIG. 3*b*, the air inlet 208 can project out from the body 207.

In FIG. 3*c* a back side view of the connector 205 from the side facing the outside when in use is shown. The connector can comprise an air outlet 220. The air outlet 220 can be provided in the body 207. The air outlet 220 can be provided with a lid 219 having holes. The holes can be provided in a mesh like structure.

Figure 4:
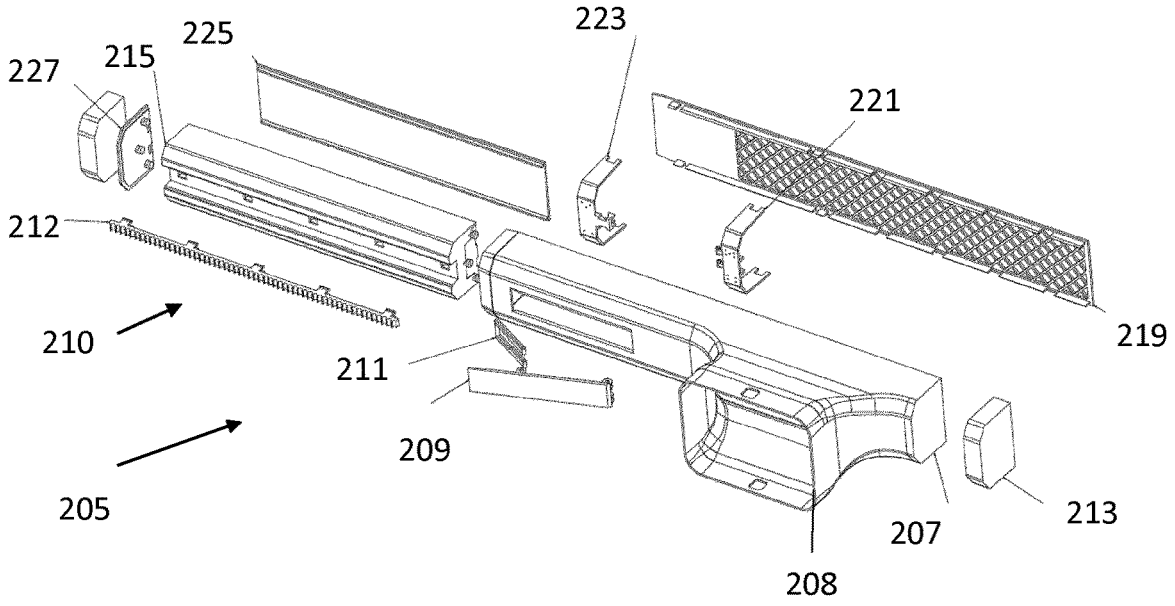
FIG. 4 is an exploded view of a window connector.

FIG. 4 shows an exploded view of a connector 205. The connector 205 has a generally elongated shape. The exemplary connector 205 in accordance with FIG. 4 has a body 207. The body 207 is interacting with a telescopic part 215. The telescopic part 215 can be slid in relation to the body 207 thereby providing a connector 205 of variable length in the length direction of the elongated connector. The length can be locked in a number of predetermined positions by a locking mechanism 210 provided in the connector 205. The locking mechanism 210 can be adapted to both lock and extend the connector in one single motion. The locking mechanism 210 can be provided by a lever 209 having a lock 211 adapted to come into a locking state with an insert 212. The insert 212 can be provided with projections and the lock 211 can have a member adapted to engage the projections. In accordance with one embodiment the insert is provided with teeth forming the projections. Thus, when the lever is manipulated the lock will be moved to engage a projection of the insert 212 and move the insert 212 in a direction extending the telescopic 215 part away from the body 207 thereby extending the length of the connector 205. When the lever is actuated to reach a first end position the telescopic part will be extended away from the body 207 and in a locked state. In its other, second, end position the lever will have released the lock 211 and the telescopic part can be freely moved in relation to the body 207 and a user can opt to let the lock 211 interact with another projection of the insert 212. Hereby the connector 205 can be made to fit windows of different sizes.

The connector 205 can also comprise elastic member(s) 213 making the connector 205 elastic in the length direction to facilitate keeping the connector in place when mounted in a window frame. Further an air inlet 208 and an air let are provided. The air outlet can be provided with a lid 219. Further, the connector can have a pivot insert 221 and a hook insert 223. The inserts 221 and 223 are components for the locking mechanism 210 along with the lever 209, the teethed insert 212 and the lock 211. The pivot insert 221 provides a pivoting point to the lever 209 and connects it to the main body 207. The hook insert 223 is adapted to hold the lock 211 when the lever 209 is in the open position so that there is no contact between lock 211 and teethed insert 212 and the telescopic element 215 can slide freely. Further the telescopic part can be provided with an end member 227 and a lid 225.

Using the connector as described herein will provide a window connector that fits in many different window sizes and which is easy to mount and dismount. In particular a locking mechanism can be implemented allowing the telescopic element to be free to be adjusted to the size of the window when a manipulation element such as a lever is open, and to be pressed against the frame and locked when the manipulation element is closed.

The invention claimed is:

1. A connector to fit in a window gap, the connector comprising:

a first part and a second part connected together to form a generally elongated shape, the first part being selectively slidable relative to the second part;

an air inlet configured to connect to an exhaust outlet of an air conditioner, and receive air flowing from the exhaust outlet;

an air outlet;

a toothed insert located in the second part; and a locking mechanism including a lever and a lock located in the first part, wherein the first part comprises a body and the second part comprises a telescopic part, the body defines a chamber extending from the air inlet to the air outlet, the chamber receiving the air from the air conditioner via the air inlet and directing the air through the air outlet, the telescopic part defining a boundary of the chamber, the telescopic part slides in a first direction inside the body to move the boundary of the chamber in the first direction and decrease a volume of the chamber and decrease a size of the air outlet, the telescopic part slides in a second direction opposite the first direction inside the body to move the boundary of the chamber in the second direction and increase the volume of the chamber and increase the size of the air outlet, and the body and the telescopic part are reconfigurable between:

a first state in which the lever positions the lock in an opened position away from the toothed insert allowing the telescopic part to slide inside of the body in the first direction and the second direction, and a second state in which the lever positions the lock in locked position in contact with the toothed insert locking the body and the telescopic part in relation to each other in the first direction and the second direction by a locking mechanism, wherein the first part and the second part form a substantially rectangular body configured to fit in the window gap.

2. The connector according to claim 1, wherein the connector is configured to expand in the second direction when moved from the first state to the second state.

3. The connector according to claim 1, wherein at least one elastic member is provided in the connector.

4. The connector according to claim 3, wherein a respective elastic member is provided at each end section of the connector, and each respective elastic member is configured to, when in use, press against a window frame.

5. The connector according to claim 3, wherein the at least one elastic member is more elastic than the body and the telescopic part.

6. The connector according to claim 1, wherein the toothed insert comprises a plurality of teeth forming projections protruding from the telescopic part.

7. A portable air-conditioner system configured to blow air through a window, the portable air conditioner system comprising:

an air-conditioning unit having an air-conditioner exhaust outlet;

a first body having a body inlet configured to connect to the air-conditioner exhaust outlet to receive air flowing from the exhaust outlet, and a body outlet in fluid communication with the body inlet, the first body being hollow and elongated along an axis, the first body including a lock and a lever; and a second body telescopically connected to the first body, and slidable along the axis between a first position in which a combined length of the first body and the second body has a first value, and a second position in which the combined length of the first body and the second body has a second value, the second value being higher than the first, the second body including a toothed insert, wherein first body defines a chamber extending from the air inlet to the air outlet, the chamber receiving the air from an air conditioner via the body inlet and directing the air through the body outlet, the second body defining a boundary of the chamber, the second body slides in a first direction inside the first body to move the boundary of the chamber in the first direction and decrease a volume of the chamber and decrease a size of the air outlet, the second body slides in a second direction opposite the first direction inside the first body to move the boundary of the chamber in the second direction and increase the volume of the chamber and increase the size of the air outlet, wherein the first body and the second body are reconfigurable between:

a first state in which the lever positions the lock in an opened position away from the toothed insert allowing the second body to slide inside of the first body in the first direction and the second direction, and a second state in which the lever positions the lock in locked position in contact with the toothed insert locking the first body and the second body in relation to each other in the first direction and the second direction, wherein the first part and the second part form a substantially rectangular body configured to fit in the window gap.

8. The portable air-conditioner system of claim 7, wherein the toothed insert comprises a plurality of teeth protruding from the second body and arranged in a row along the axis.

9. The portable air-conditioner system of claim 7, wherein the body inlet is located on a first side of the first body, and the body outlet is located on a second side of the first body, the second side being opposite the first side.

* * * * *